US006647729B2

(12) United States Patent
Calvez et al.

(10) Patent No.: US 6,647,729 B2
(45) Date of Patent: Nov. 18, 2003

(54) COMBUSTION CHAMBER PROVIDED WITH A SYSTEM FOR FIXING THE CHAMBER END WALL

(75) Inventors: Gwénaëlle Calvez, Melun (FR); Alexandre Forestier, Boissise la Bertrand (FR); Didier Hernandez, Quiers (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 10/161,653

(22) Filed: Jun. 5, 2002

(65) Prior Publication Data

US 2002/0184887 A1 Dec. 12, 2002

(30) Foreign Application Priority Data

Jun. 6, 2001 (FR) ..... 01 07368

(51) Int. Cl.[7] ..... F23R 3/60
(52) U.S. Cl. ..... 60/753; 60/800
(58) Field of Search ..... 60/753, 796, 798, 60/759, 800, 804; 29/890.02; 431/202, 343

(56) References Cited

U.S. PATENT DOCUMENTS

| | | | | |
|---|---|---|---|---|
| 5,142,871 A | | 9/1992 | Lampes et al. | |
| 5,291,732 A | | 3/1994 | Halila | |
| 5,457,954 A | * | 10/1995 | Boyd et al. | 60/753 |
| 5,609,031 A | * | 3/1997 | Jones | 60/753 |
| 6,495,207 B1 | * | 12/2002 | Prociw et al. | 427/245 |
| 6,571,560 B2 | * | 6/2003 | Tatsumi et al. | 60/753 |

FOREIGN PATENT DOCUMENTS

EP 0 564 183 10/1993

* cited by examiner

*Primary Examiner*—Louis J. Casaregola
(74) *Attorney, Agent, or Firm*—Oblon, Spivak, McClelland, Maier & Neustadt, P.C.

(57) ABSTRACT

In an annular combustion chamber having inner and outer axially-extending side walls of composite material and an end wall of metal material, provision is made to hold the end wall in position between the side walls of the annular combustion chamber by means of a plurality of flexible metal tongues fixed firstly to said side walls by fixing means and secondly to said end wall by brazing or welding, said end wall further comprising means for providing sealing between said end wall and said side walls.

13 Claims, 5 Drawing Sheets

FIG.5A
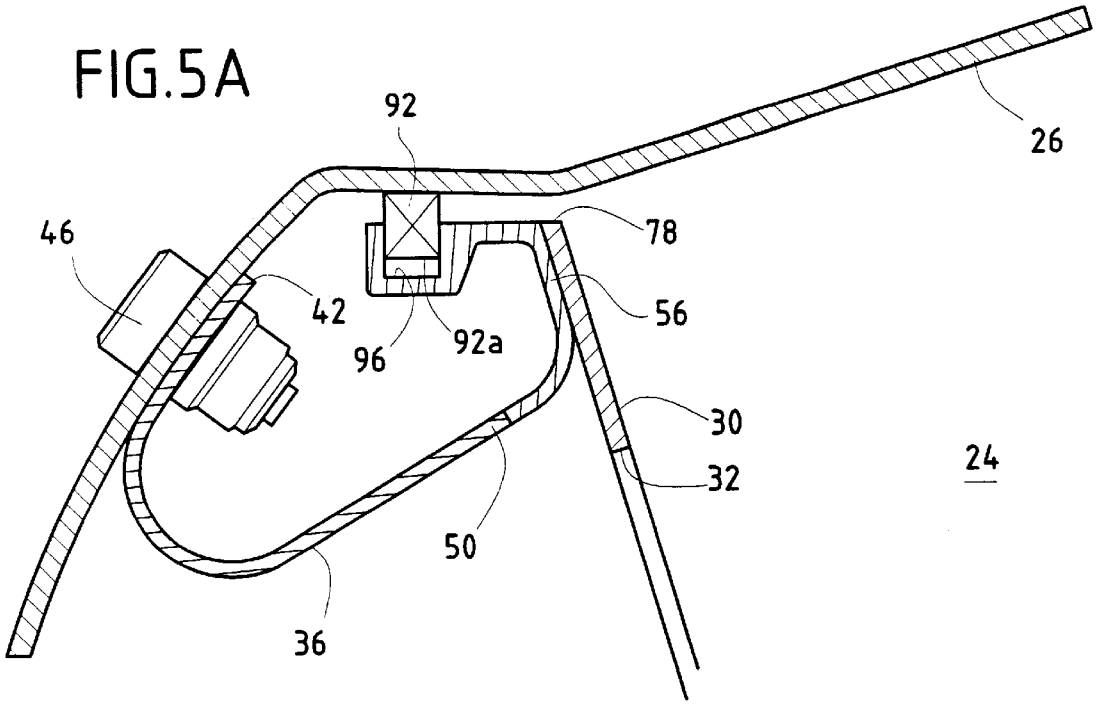
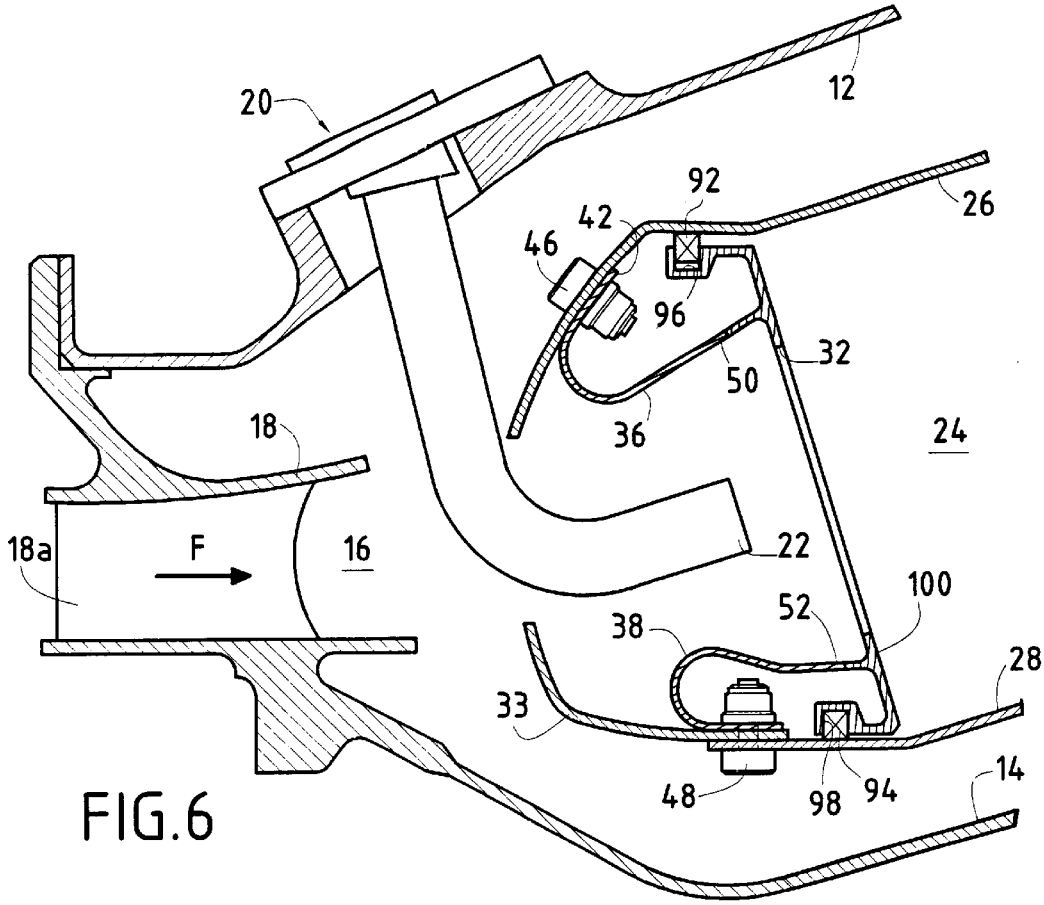
FIG.6

COMBUSTION CHAMBER PROVIDED WITH A SYSTEM FOR FIXING THE CHAMBER END WALL

FIELD OF THE INVENTION

The present invention relates to the specific field of turbomachines, and more particularly it relates to the problem posed by mounting a metal end wall for a turbomachine combustion chamber on the side walls of said chamber when the side walls are made of ceramic matrix composite (CMC) type material.

PRIOR ART

Conventionally, in a turbojet or a turboprop, the high pressure turbine (HPT), and in particular its inlet nozzle, the injection system, the combustion chamber, and the annular shell of said chamber are all made of metal type materials. However, under certain particular conditions of use employing particularly high combustion temperatures, a combustion chamber that is made entirely out of metal is completely unsuitable from a thermal point of view and it is necessary to use a chamber based on high temperature composite materials of the CMC type. However, the difficulties involved in working these materials and their high costs mean that use of such materials is usually restricted to the combustion chamber itself and more particularly solely to its axially-extending side walls, with the inlet nozzle of the high pressure turbine, the injection system, and the annular shell continuing to be made more conventionally out of metal materials. Unfortunately, metal materials and composite materials have coefficients of thermal expansion that are very different. This gives rise to problems that are particularly severe at the connections between the composite material side walls of the combustion chamber and its metal end wall.

OBJECT AND BRIEF SUMMARY OF THE INVENTION

The present invention mitigates those drawbacks by proposing a mounting for a metal end wall of a combustion chamber that has the ability to absorb the movements induced by the different coefficients of expansion between said metal end wall and the composite side walls of the combustion chamber.

These objects are achieved by an annular combustion chamber having outer and inner axially-extending side walls of composite material and an end wall of metal material, wherein, in order to enable said end wall to expand freely in a radial direction relative to said side walls, said end wall is held in position between said inner and outer side walls by a plurality of flexible tongues fixed firstly to said side walls by fixing means and secondly to said end wall by brazing or welding, said end wall further including means for providing sealing between said end wall and said side walls.

With this fixing system based on flexible tongues, expansion of the metal end wall of the chamber is absorbed without damaging the composite material side walls. The tongues can accommodate the forces due to the large amount of expansion of the end wall without stressing the side walls which, in contrast, expand little.

The flexible fixing tongues are made of a metal material and the fixing means are constituted by a plurality of bolts, preferably having captive nuts.

In an embodiment, the sealing means comprise a circular gasket of the laminated type mounted in a circular groove of said metal end wall of the chamber and designed to bear against the facing one of said side walls of the combustion chamber. The circular gasket is preferably subdivided into sectors and is held pressed against said side wall by means of a resilient element fixed on said metal end wall. The resilient element is constituted by spring blades.

In an alternative embodiment, the sealing means comprise a circular segment mounted against said side wall and designed to co-operate with a circular groove in said metal end wall of the chamber. The circular sealing segment is preferably split.

In an advantageous embodiment, the flexible fixing tongues have respective first ends fixed to one or other of said side walls by said fixing means and respective second ends fixed to said end wall of the combustion chamber by brazing or welding. Under such circumstances, the end wall can also have a metal ring onto which the second end of said flexible fixing tongues are brazed or welded.

In another embodiment, the flexible fixing tongues have respective first ends fixed to one of said side walls by first connection means and respective second ends fixed to the other one of said side walls by second connection means, together with respective central portions fixed to the end wall by brazing or welding. Advantageously, the flexible fixing tongues are disposed between successive injection nozzles.

BRIEF DESCRIPTION OF THE DRAWINGS

The characteristics and advantages of the present invention appear better from the following description given by way of non-limiting indication and with reference to the accompanying drawings, in which:

FIG. 5A shows a detail of the FIG. 5 assembly;

FIG. 6 is a diagrammatic axial half-section of an injection portion of a turbomachine incorporating a first variant of the second embodiment of an assembly of the invention.

DETAILED DESCRIPTION OF THE PREFERRED EMBODIMENTS

Figure 1:
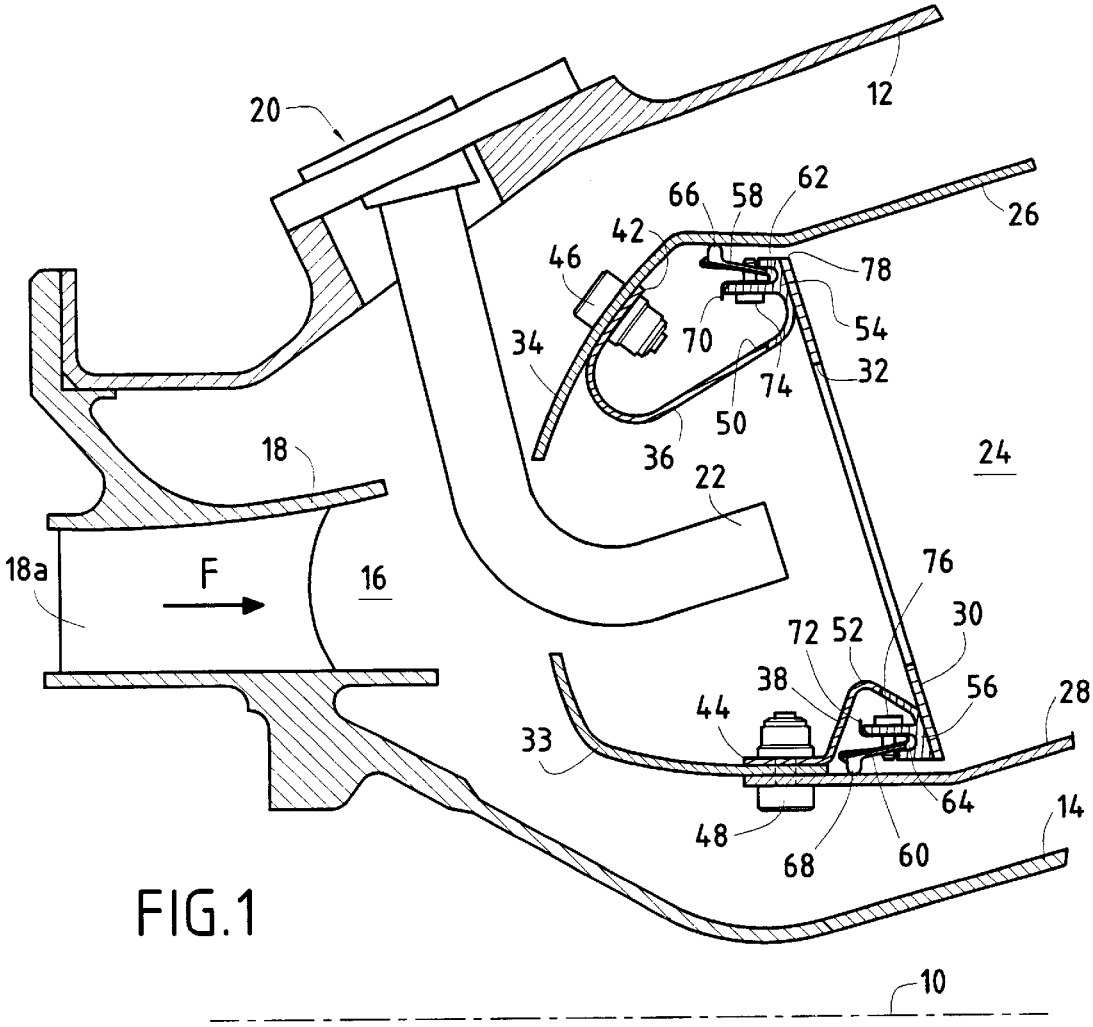
FIG. 1 is a diagrammatic axial half-section of an injection portion of a turbomachine incorporating a first embodiment of an assembly of the invention.

FIG. 1 is an axial half-section showing an injection portion of a turbomachine, comprising:

- an outer shell (or outer casing) 12 that is annular about a longitudinal axis 10;
- a coaxial annular inner shell (or inner casing) 14; and
- an annular space 16 extending between the two shells 12 and 14 and receiving the compressed oxidizer, generally air, coming from an upstream compressor (not shown) of the turbomachine via an annular diffusion duct 18 (having a diffusion screen 18*a*) defining a general gas flow F.

In the gas flow direction, this space 16 contains firstly an injection assembly formed by a plurality of injection systems 20 regularly distributed around the duct 18 and each comprising a fuel injection nozzle 22 fixed on the annular outer shell 12 (in order to simplify the drawings the mixer and the deflector associated with each injection nozzle are omitted), followed by an annular combustion chamber 24 formed by an outer axially-extending side wall 26 and an inner axially-extending side wall 28 disposed coaxially about the axis 10 and made of a high temperature composite material of the CMC type or the like (e.g. carbon), and a transversely-extending wall 30 made of a metal material and forming the end wall of the chamber, which end wall is provided with openings 32 for receiving the injection system, and finally an annular nozzle (not shown) forming an inlet stage of a high pressure turbine. In the embodiment shown, it should be observed that there is an inner cap 33 extending the inner wall 28 of the combustion chamber upstream relative to the flow F. In contrast, an outer cap 34 can be directly integrated in the outer wall 26 of the combustion chamber.

The metal end wall 30 of the combustion chamber has a coefficient of thermal expansion that is very different from the coefficient of thermal expansion of the inner and outer side walls 26 and 28 of the combustion chamber, since they are made of composite material. In accordance with the invention, the end wall 30 is held securely in position between the side walls by a plurality of flexible tongues 36, 38 that are regularly distributed between the fuel injection nozzles 22 (see FIG. 4, for example). A first series of these fixing tongues (see the tongue referenced 36) is mounted between the metal end wall 30 and the outer side wall 26, and a second series of these tongues (see the tongue referenced 38) is mounted between the metal end wall 30 and the inner side wall 28. Each flexible fixing tongue is made of a metal material and is preferably constituted by a thin blade, optionally of constant width, having an attachment point at each of its two ends.

Figure 1A:
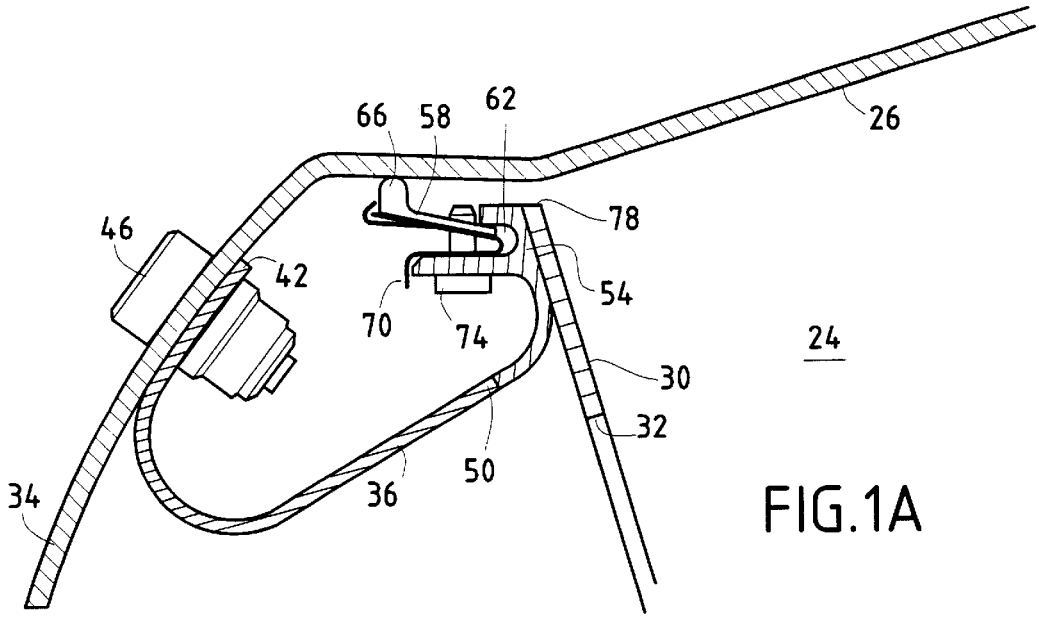
FIG. 1A shows a detail of the FIG. 1 assembly.

In a first embodiment shown in FIG. 1 (see also the detail of FIG. 1A), the first end 42; 44 of the fixing tongue is secured to one or the other of the inner and outer side walls 26 and 28 of the combustion chamber by first fixing means 46; 48, and the second end 50; 52 is preferably fixed by welding or brazing to a metal ring 54; 56 itself brazed or welded to the metal end wall 30 of the combustion chamber. This connection enables expansion of the chamber end wall to be absorbed without damaging the side walls made of composite material which move little in the radial direction.

The first fixing means placed in a position that is offset relative to the injection nozzles are advantageously of the bolt type. In order to facilitate access and thus assembly and disassembly, these bolts are preferably selected to be of the captive nut type.

Sealing between the outer or inner side wall and the metal ring is provided by a respective laminated type circular gasket 58; 60 mounted in a circular groove 62; 64 of the metal ring. This sealing ring is advantageously subdivided into sectors, and in its upstream portion it has a corresponding rim 66; 68 for pressing toroidally against the facing side wall 26; 28 of the combustion chamber. The gasket is pressed against the side wall by a resilient element 70; 72, preferably constituted by spring blades, and it is held in position by a plurality of pegs 74; 76 secured to the ring. It should be observed that the clearance around the outer peripheral edge 78 of the chamber end wall (and the corresponding edge of the metal ring) is designed so that, in operation, the metal ring does not press against the outer side wall 26 of composite material or does not even make contact therewith. Similarly, it should be observed that the gasket 60 providing sealing with the inner side wall 28 is prestressed, given that the expansion of the chamber end wall when hot has the effect of separating the end wall from the inner side wall.

Figure 2:
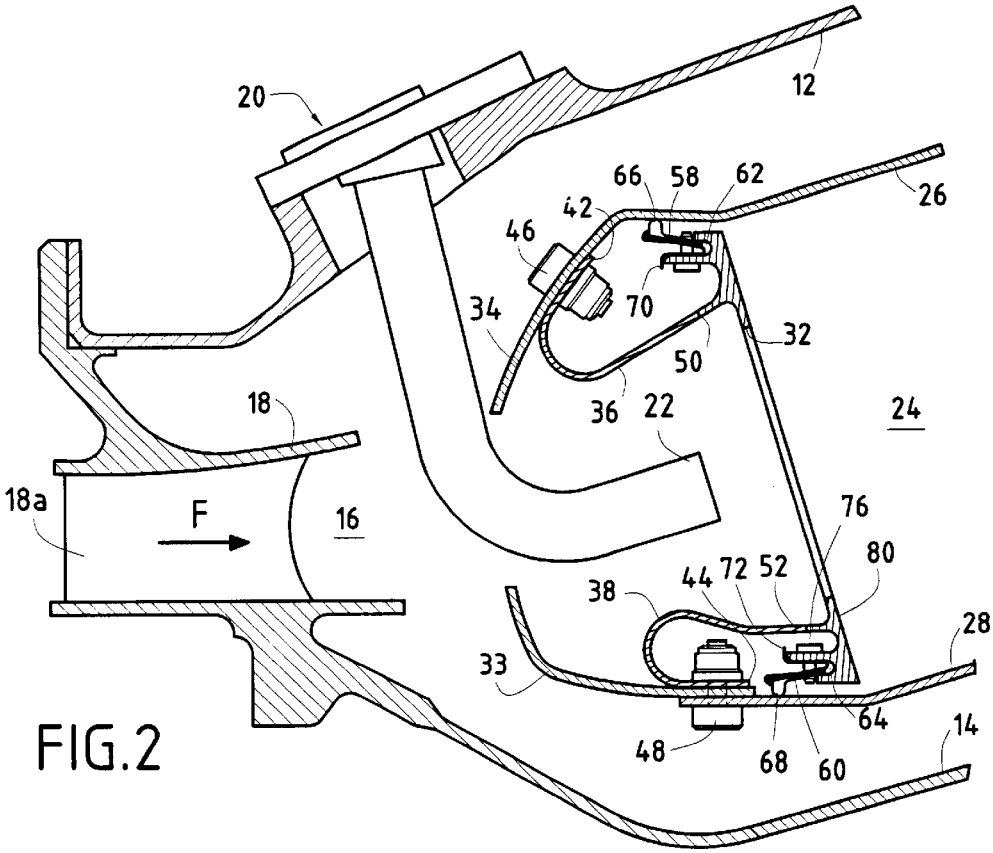
FIG. 2 is a diagrammatic axial half-section of an injection portion of a turbomachine incorporating a first variant of the first embodiment of an assembly of the invention.

FIG. 2 shows a first variant of the connection between the metal end wall and the composite material side walls of the combustion chamber, in which the end wall and the metal rings for supporting the fixing tongues constitute a single piece 80, with the second ends 50; 52 of the tongues being brazed or welded directly thereto. This single piece naturally includes the above-described sealing means.

Figure 3:
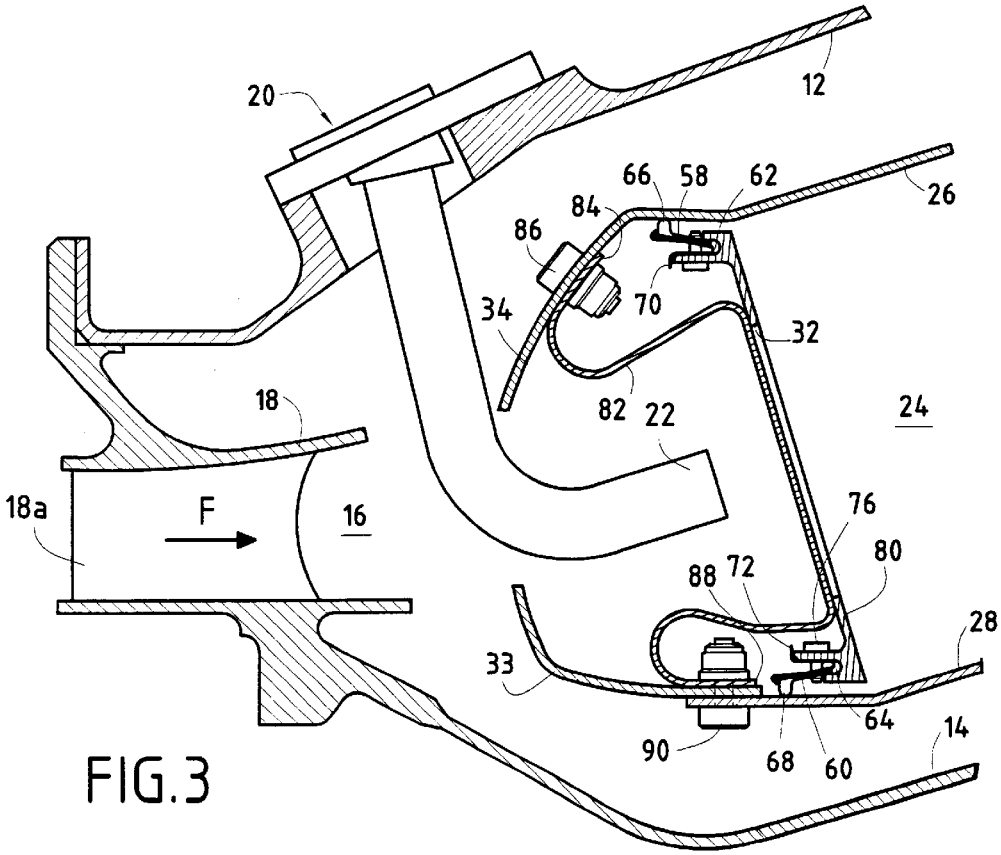
FIG. 3 is a diagrammatic axial half-section of an injection portion of a turbomachine incorporating a second variant of the first embodiment of an assembly of the invention.
Figure 4:
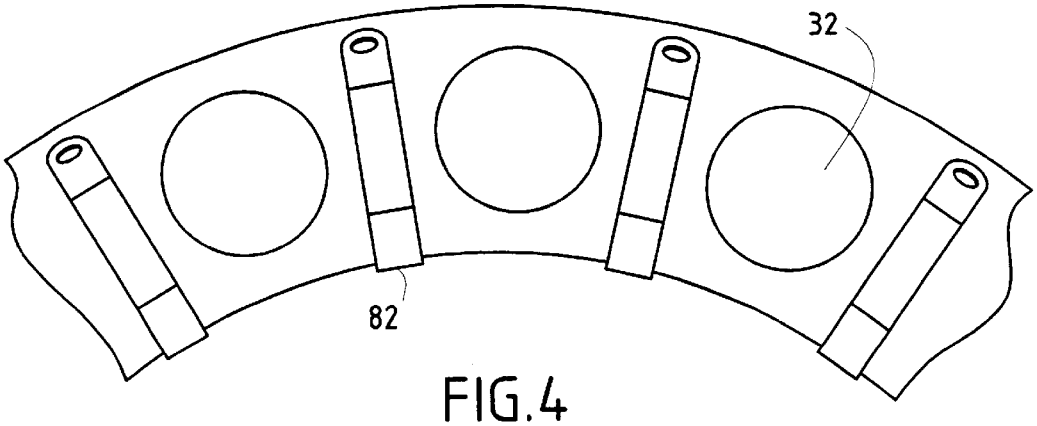
FIG. 4 is a fragmentary end view showing the alternating disposition of injection nozzles and fixing tongues.

A second variant is shown in FIGS. 3 and 4 in which there is only a single series of tongues 82, each having a first end 84 fixed to the outer side wall 26 by first connection means 86 and a second end 88 fixed to the inner side wall 28 by second connection means 90. These first and second connection means are advantageously of the bolt type. The tongue is also brazed (or welded) to the chamber end wall which can be formed by the single piece 80 of the preceding variant. Naturally this brazing is performed in the gaps between the openings 32 for the injectors.

Figure 5:
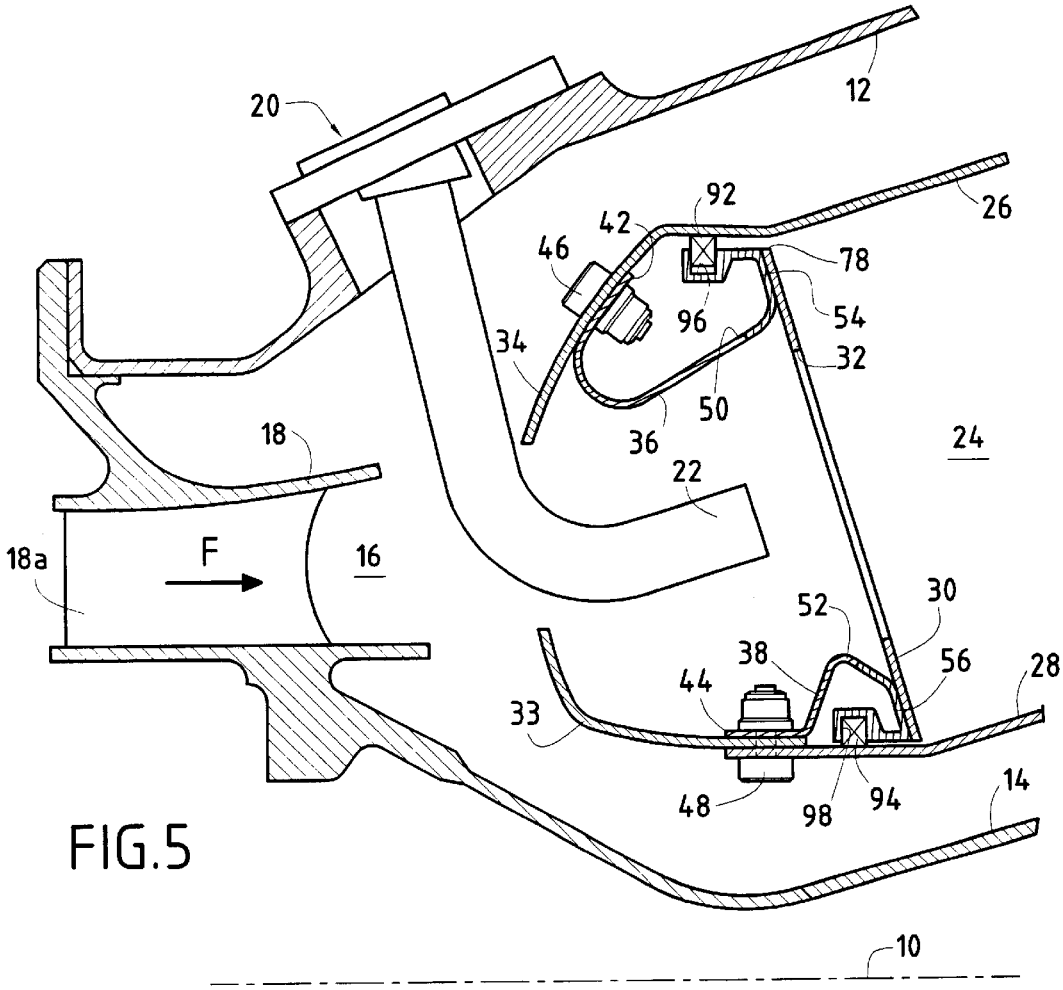
FIG. 5 is a diagrammatic axial half-section of an injection portion of a turbomachine incorporating a second embodiment of an assembly of the invention.

FIG. 5 shows a second embodiment (see also the detail of FIG. 5A) in which sealing between the outer side wall 26 or the inner side wall 28 and the end wall 30 of the chamber is no longer provided by a spring blade type circular gasket but by an open split circular segment 92; 94 mounted tightly against the side wall and provided with a gasket-covering system for co-operating with a circular groove 96; 98 of the metal ring 54; 56. The clearance at the bottom of the groove 96 for receiving the outer segment 92 is designed so that, in operation, the metal ring does not come into contact either with the outer side wall 26 of composite material or with the inside face 92*a* of the segment 92. Similarly, the segment 94 of the inner wall is prestressed, since the expansion of the chamber end wall when hot has the effect of moving it away from the inner side wall.

Otherwise, and like the first embodiment, the first ends 42; 44 of the fixing tongues 36; 38 are secured to one or the other of the outer and inner side walls 26 and 28 of the combustion chamber via the first fixing means 42; 48, while the second ends 50; 52 are fixed preferably by brazing or welding to the metal rings 54; 56, themselves brazed or welded to the metal end wall 30 of the combustion chamber.

FIG. 6 shows a first variant of the second embodiment in which the chamber end wall and the metal rings for supporting the fixing tongues comprise a single piece 100 having the second ends of the tongues 50; 52 brazed or welded directly thereto. This single piece naturally includes the above-described segment sealing means.

Figure 7:
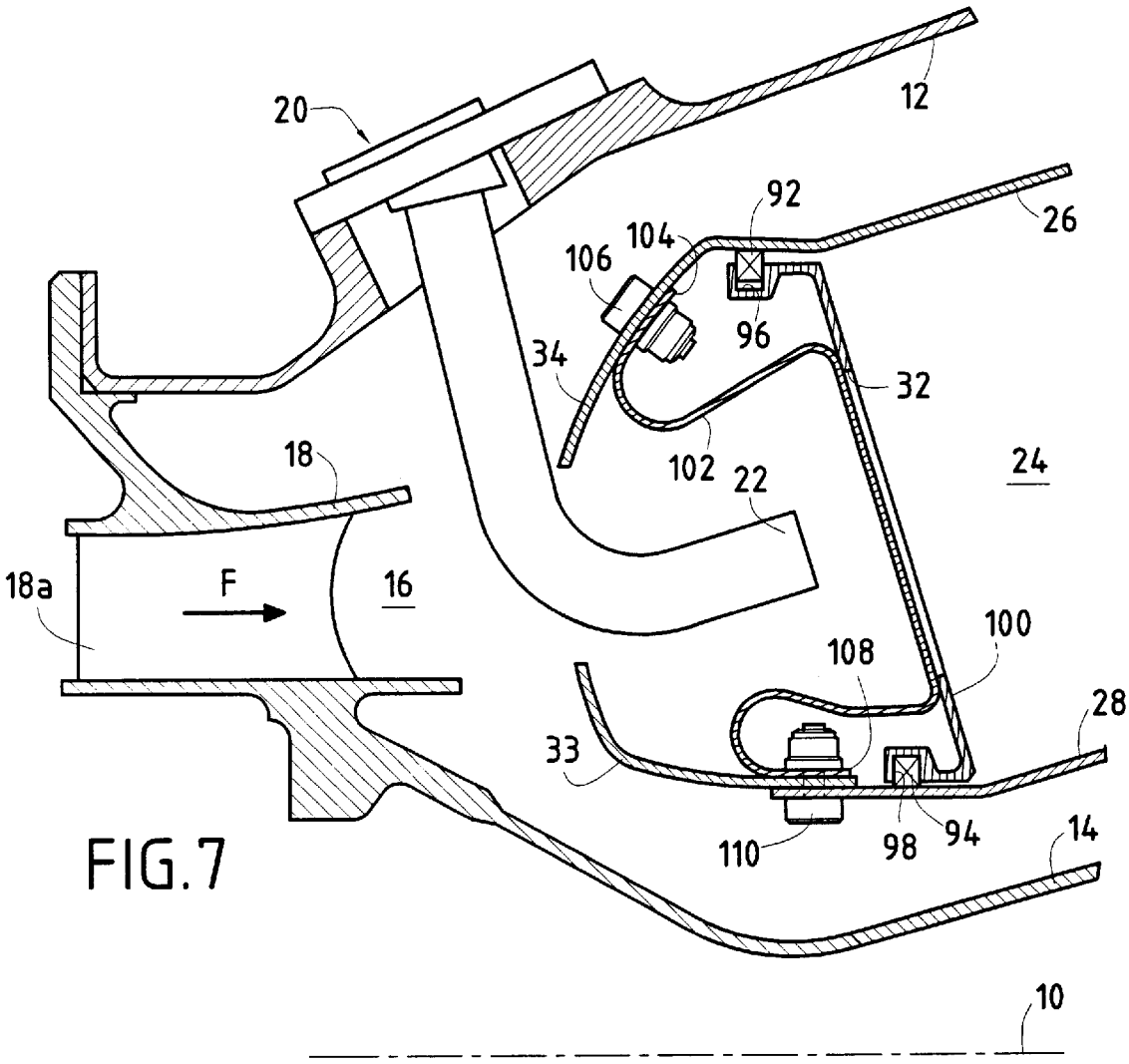
FIG. 7 is a diagrammatic axial half-section of an injection portion of a turbomachine incorporating a second variant of the second embodiment of an assembly of the invention.

A second variant is shown in FIG. 7 in which there exists only a single series of tongues 102, each having a first end 104 fixed to the outer side wall 26 by first connection means 106 and a second end 108 fixed to the inner side wall 28 by second connection means 110. These first and second fixing means are advantageously of the bolt type. The tongue is also brazed (or welded) to the chamber end wall which can be formed by the single piece 100 of the preceding variant, for example. This brazing is naturally performed in the gaps between the openings 32 for the injectors.

What is claimed is:

1. An annular combustion chamber having outer and inner axially-extending side walls of composite material and an end wall of metal material, wherein, in order to enable said end wall to expand freely in a radial direction relative to said side walls, said end wall is held in position between said inner and outer side walls by a plurality of flexible tongues fixed firstly to said side walls by fixing means and secondly to said end wall by brazing or welding, said end wall further including means for providing sealing between said end wall and said side walls.

2. A combustion chamber according to claim 1, wherein said flexible fixing tongues are made of a metal material.

3. A combustion chamber according to claim 1, wherein said fixing means are constituted by a plurality of bolts, preferably having captive nuts.

4. A combustion chamber according to claim 1, wherein said sealing means comprise a laminated type circular gasket mounted in a circular groove of said metal end wall and designed to press against the facing one of said side walls of the combustion chamber.

5. A combustion chamber according to claim 4, wherein said circular sealing gasket is subdivided into sectors.

6. A combustion chamber according to claim 4, wherein said circular sealing gasket is held pressed against said side wall by means of a resilient element fixed to said metal end wall of the chamber.

7. A combustion chamber according to claim 6, wherein said resilient element is constituted by spring blades.

8. A combustion chamber according to claim 1, wherein said sealing means comprise a circular segment mounted against said side wall and designed to co-operate with a circular groove of said metal end wall.

9. A combustion chamber according to claim 8, wherein said circular sealing segment is split.

10. A combustion chamber according to claim 1, wherein each of said flexible fixing tongues has a first end fixed to one or the other of said side walls by said fixing means, and a second end fixed to said end wall by brazing or welding.

11. A combustion chamber according to claim 10, wherein said end wall further comprises a metal ring having said second ends of said flexible fixing tongues brazed or welded thereto.

12. A combustion chamber according to claim 1, wherein each flexible fixing tongue has a first end fixed to one of said side walls by first connection means, a second end fixed to the other one of said side walls by second connection means, and a central portion fixed to the end wall by brazing or welding.

13. A combustion chamber according to claim 12, wherein said flexible fixing tongues are disposed between successive injection nozzles.

* * * * *